US007694348B1

(12) United States Patent
Smith

(10) Patent No.: US 7,694,348 B1
(45) Date of Patent: Apr. 13, 2010

(54) METHOD AND APPARATUS OF PREVENTING SUNBURN

(76) Inventor: Stephen Smith, #8 Meldia Dr., Little Rock, AR (US) 72209

( * ) Notice: Subject to any disclaimer, the term of this patent is extended or adjusted under 35 U.S.C. 154(b) by 32 days.

(21) Appl. No.: 12/070,820

(22) Filed: Feb. 22, 2008

(51) Int. Cl.
*A41D 13/00* (2006.01)

(52) U.S. Cl. ..... 2/16

(58) Field of Classification Search ..... 2/16, 2/455, 6.5, 411, 414
See application file for complete search history.

(56) References Cited

U.S. PATENT DOCUMENTS 5,357,633 A * 10/1994 Rael ..... 2/16
5,628,062 A * 5/1997 Tseng ..... 2/16
5,727,256 A * 3/1998 Rudman ..... 2/115
5,974,586 A * 11/1999 Reinoso ..... 2/16
6,098,208 A * 8/2000 Cordon ..... 2/455
6,374,408 B1 * 4/2002 Tomlinson et al. ..... 2/22
6,880,172 B2 * 4/2005 Quintero ..... 2/16

* cited by examiner

*Primary Examiner*—Tejash Patel
(74) *Attorney, Agent, or Firm*—Stephen D. Carver

(57) ABSTRACT

A method and apparatus of preventing sunburn includes a forearm guard, which includes a first panel having a front edge, a rear edge, a first lateral edge and a second lateral edge. A coupler is attached to the first panel for selectively coupling an inner surface of the first panel to an outer surface of the first panel. The forearm guard is extended around a forearm and coupled thereto with the coupler. An upper armguard includes a second panel having an upper edge, a lower edge, a first side edge and a second side edge. A biasing member is attached to the second panel for biasing the first and second side edges toward each other. An arm may be extended between the biasing member and the second panel so that the upper armguard is positioned on a front portion of an upper arm.

10 Claims, 4 Drawing Sheets

METHOD AND APPARATUS OF PREVENTING SUNBURN

BACKGROUND OF THE INVENTION

1. Field of the Invention

The present invention relates to body covering devices and more particularly pertains to a new body covering device for preventing sunburn and skin damage to body parts exposed to the sun while driving.

2. Description of the Prior Art

The use of body covering devices is known in the prior art. U.S. Pat. No. 5,974,586 describes a pair of sleeves that may worn over the arms to protect the arms from sunlight. Another type of body covering device is U.S. Pat. No. 5,357,633, which again includes a sleeve for covering an arm but also including a closed end having a thumb opening extending therethrough. Yet another sleeve device is shown in U.S. Pat. No. 5,628,062.

While these devices fulfill their respective, particular objectives and requirements, the need remains for a device that includes multiple components so that an entire sleeve need not be worn and so that an under portion of the arm is exposed as well as the hand to ensure that those covered portions do become overly warm. Additionally, it would be beneficial to include a component that may be used for covering the chest of a person using the device.

SUMMARY OF THE INVENTION

To this end, the present invention generally comprises a forearm guard that includes a first panel having a front edge, a rear edge, a first lateral edge and a second lateral edge. The first panel is comprised of a flexible material. A coupler is attached to the first panel for selectively coupling an inner surface of the first panel adjacent to the first lateral edge to an outer surface of the first panel adjacent to the second lateral edge. The forearm guard is extended around a forearm so that the front edge extends around a wrist and is coupled to the forearm with the coupler. An upper armguard includes a second panel having an upper edge, a lower edge, a first side edge and a second side edge. The second panel is also comprised of a flexible material. A biasing member is attached to the second panel for biasing the first and second side edges toward each other. An arm may be extended between the biasing member and the second panel so that the upper armguard is positioned on a front portion of an upper arm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
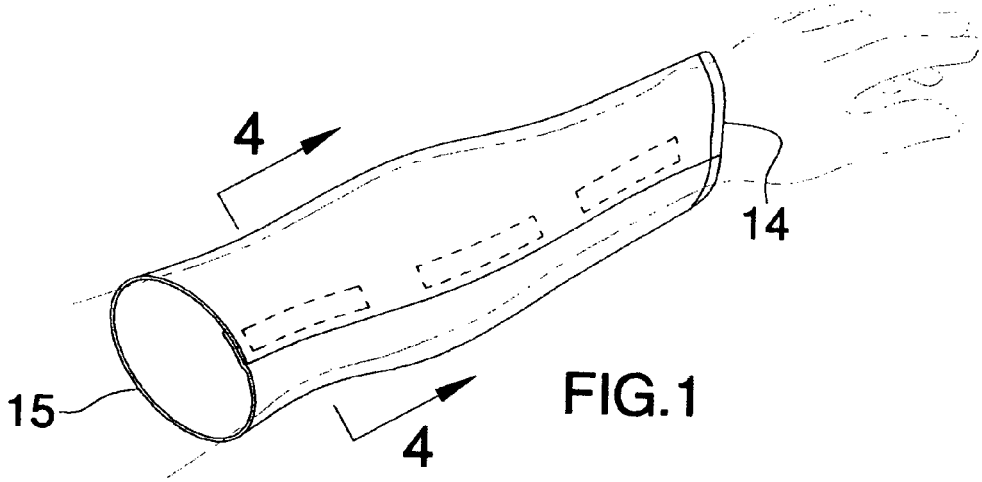
FIG. 1 is a perspective view of a method and apparatus of preventing sunburn according to the present invention.
Figure 2:
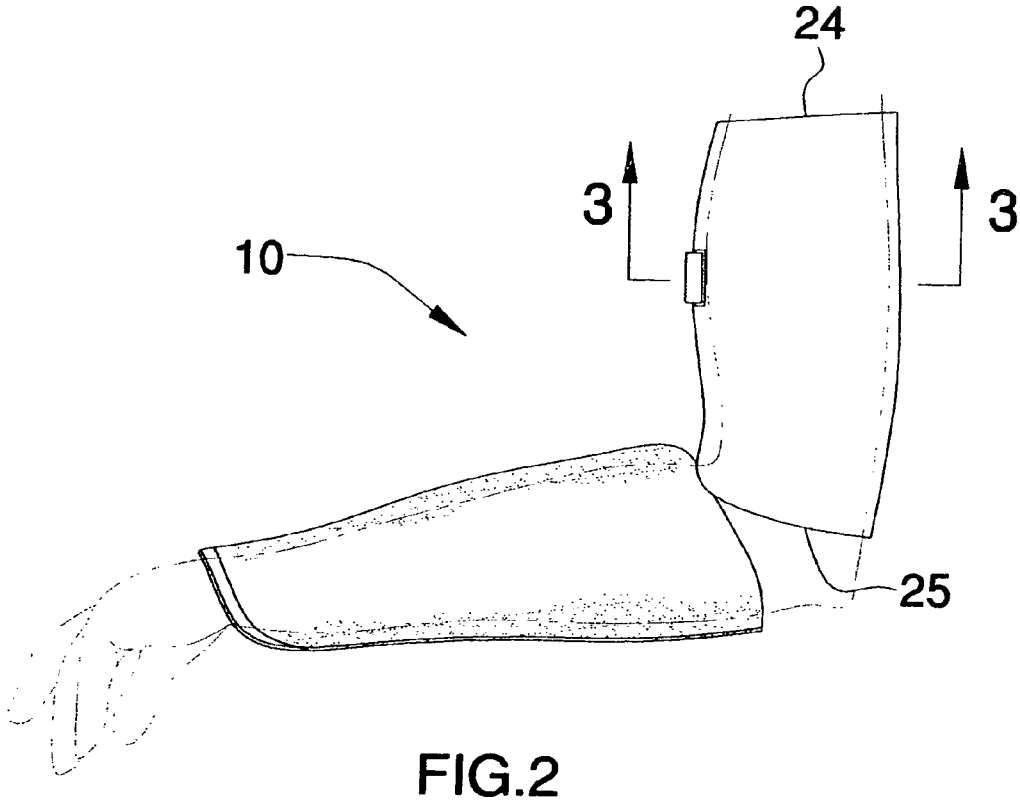
FIG. 2 is a side view of the present invention.
Figure 3:
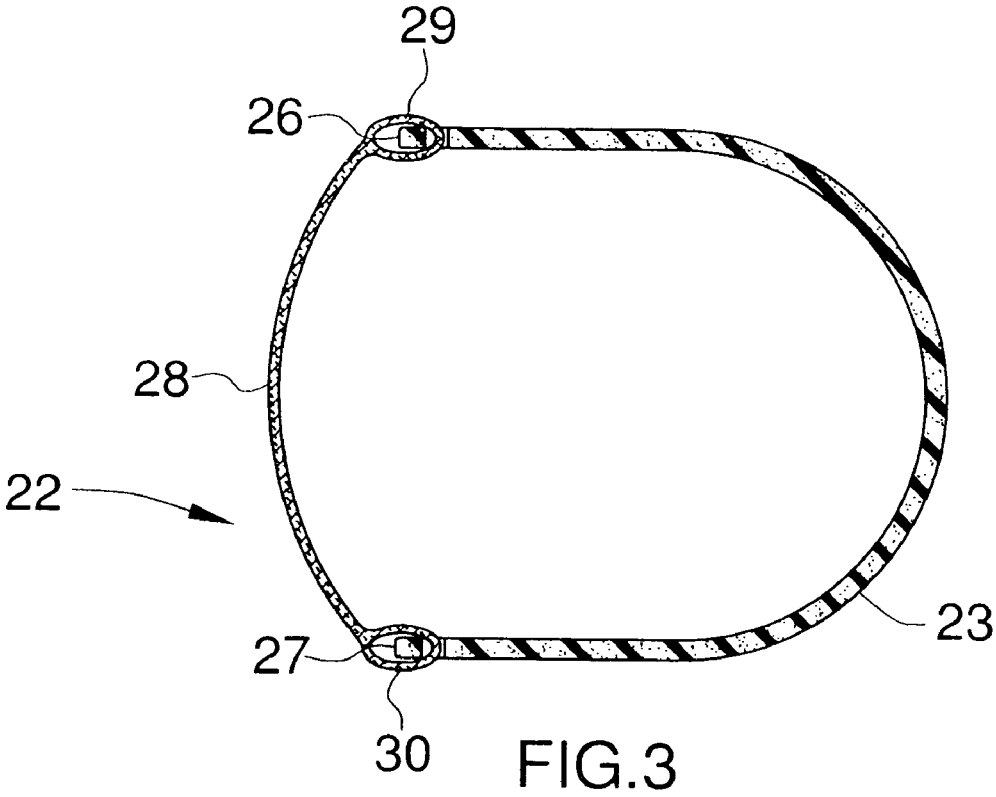
FIG. 3 is a cross-sectional view taken along line 3-3 of FIG. 2 of the present invention.
Figure 4:
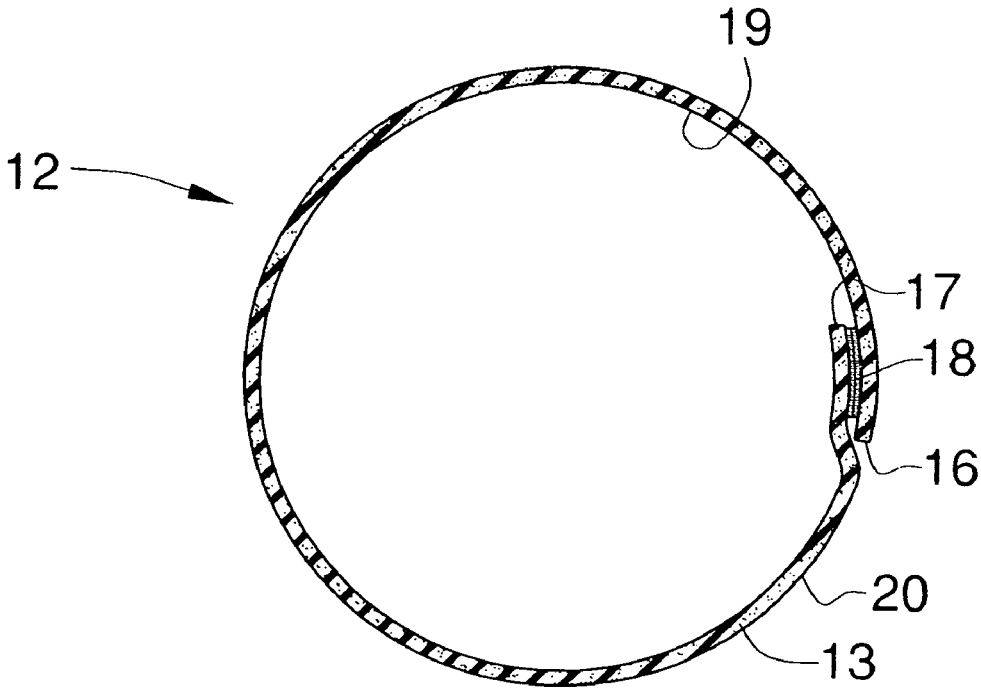
FIG. 4 is a cross-sectional view taken along line 4-4 of FIG. 1 of the present invention.
Figure 5:
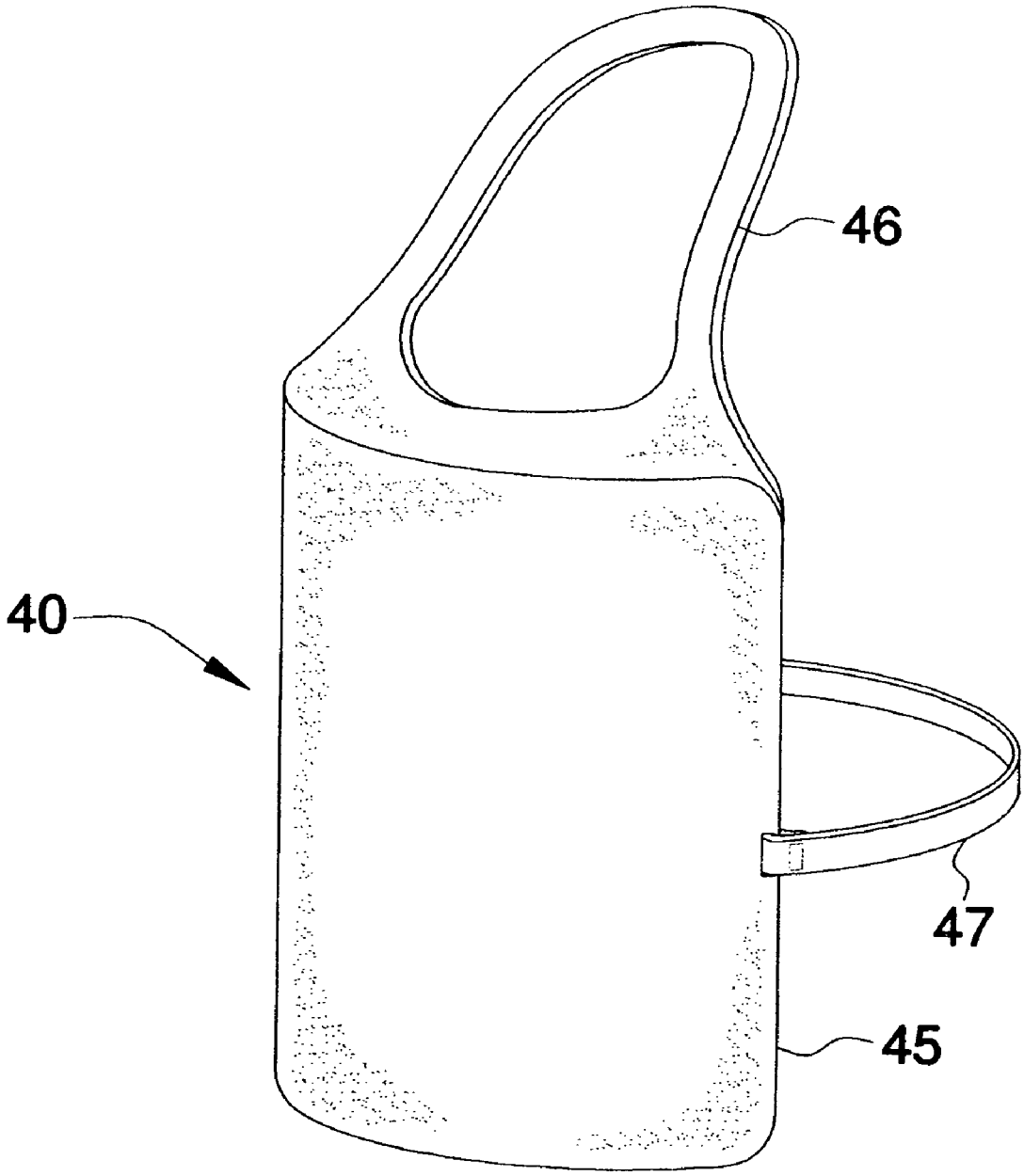
FIG. 5 is a perspective view of a chest protector of the present invention.
Figure 6:
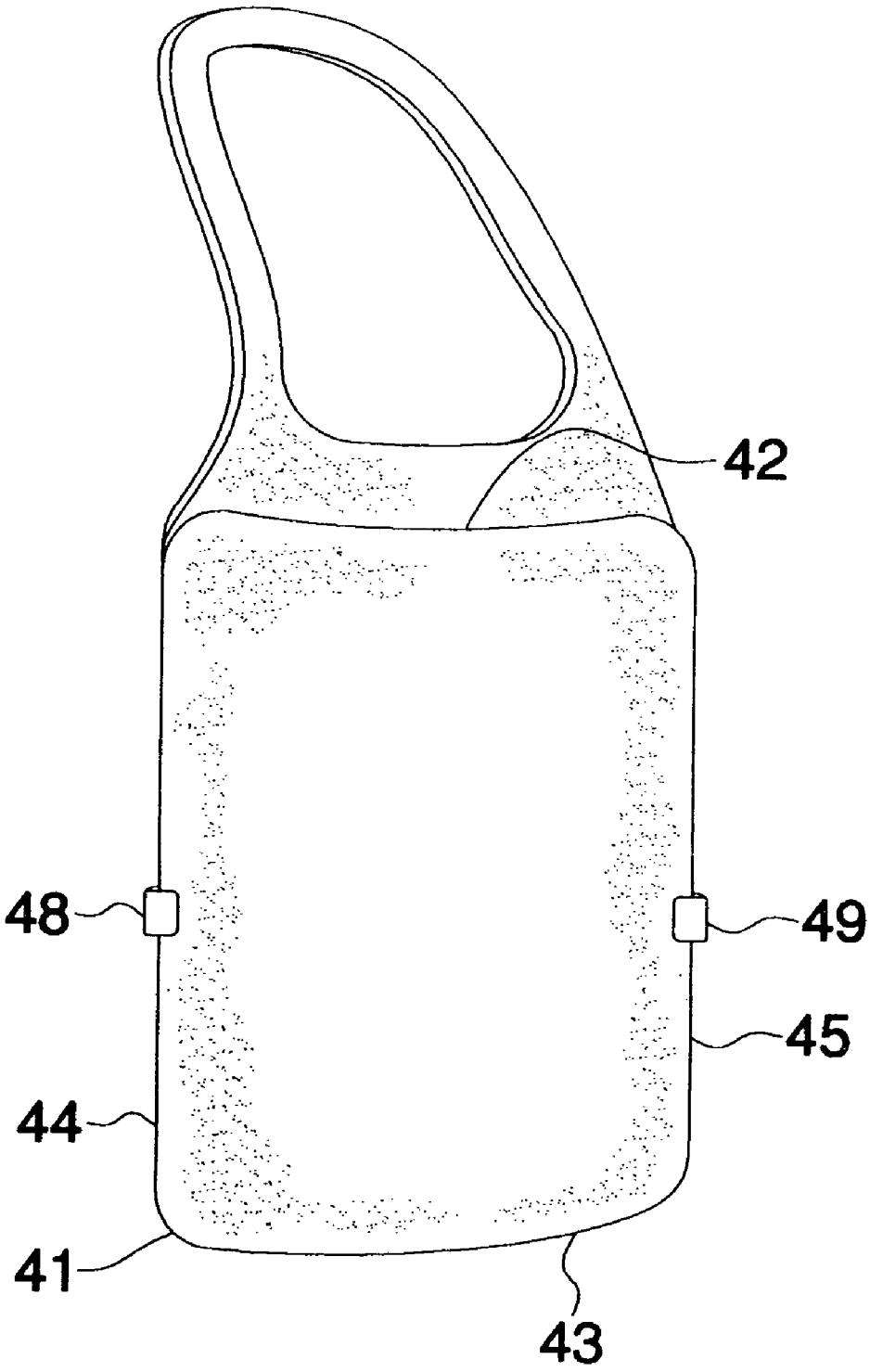
FIG. 6 is a front view of the chest protector of the present invention.

With reference now to the drawings, and in particular to FIGS. 1 through 6 thereof, a new body covering device embodying the principles and concepts of the present invention and generally designated by the reference numeral 10 will be described.

As best illustrated in FIGS. 1 through 6, the method and apparatus of preventing sunburn 10 generally comprises providing a forearm guard 12. The forearm guard 12 includes a first panel 13 that has a front edge 14, a rear edge 15, a first lateral edge 16 and a second lateral edge 17. The first panel 13 is comprised of a flexible polystyrene material. The first panel 13 has a thickness less than ½ inch. A width of the first panel 13 decreases from the rear edge 15 to the front edge 14 so that the rear edge 15 has a length generally between 8 inches and 12 inches and the front edge 14 has a length generally between 7 inches and 10 inches. The first panel 12 has a width from the first lateral edge 16 to the second lateral edge 17 generally between 10 inches and 16 inches. A coupler 18 is attached to the first panel 13 for selectively coupling an inner surface 19 of the first panel 13 adjacent to the first lateral edge 16 to an outer surface 20 of the first panel 13 adjacent to the second lateral edge 17. The coupler 18 preferably comprises a hook and loop coupling means extending along the first and second lateral side edges. In use, the forearm guard 12 is extended around a forearm so that the front edge 14 extends around a wrist and is coupled thereto with the coupler 18.

An upper armguard 22 is provided which includes a second panel 23 having an upper edge 24, a lower edge 25, a first side edge 26 and a second side edge 27. The second panel 23 is comprised of a flexible polystyrene material. The second panel 23 has a thickness less than ½ inch. A width of the second panel 23 from the first side edge 26 to the second side edge 27 is generally between 10 inches and 14 inches. The second panel 23 has a height from the lower edge 25 to the upper edge 24 generally between 5 inches and 8 inches. A biasing member 28 is attached to the second panel 23 for biasing the first 26 and second 27 side edges toward each other. The biasing member 28 comprises at least one elastic band having a first end 29 attached to the first side edge 26 and a second end 30 attached to the second side edge 27. In use an arm is extended between the biasing member 28 and the second panel 23 so that the upper armguard 22 is positioned on a front portion of an upper arm.

The method also includes a chest protector 40 that comprises a third panel 41 having a top edge 42, a bottom edge 43, a first outer edge 44 and a second outer edge 45. The third panel 41 is comprised of a flexible polystyrene material. The polystyrene used for all three panels 13, 23 and 41 is preferably foamed polystyrene such as Styrofoam. The third panel 41 has a thickness less than ½ inch. A width of the third panel 41 from the first outer edge 44 to the second outer edge 45 is generally between 12 inches and 20 inches. The third panel 41 has a height from the bottom edge 43 to the top edge 42 generally between 14 inches and 18 inches. A loop 46 is integrally coupled to and extends upwardly from the top edge 42. The loop 46 is comprised of a flexible polystyrene material. The loop 46 is angled back with respect to a front side of the third panel 41. A tether 47 has a first end 48 attached to the first outer edge 44 and a second end 49 attached to the second outer edge 45. The tether 47 comprises a resiliently elastic material. In use, a torso is extended between the tether 47 and the third panel 41 and a head extended through the loop 46 so that the chest protector is positioned on a chest of the body.

The apparatus and method 10 as described above will protect those areas covered from sunlight and is particularly useful for a person who is frequently exposed to sunlight while driving, such as semi-truck drivers. The materials used do not conduct heat well and therefore will also shield their wearer from the heat of the sun while allowing them to remain shirtless while driving.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of protecting portions of a body from sunlight, comprising the steps of:

providing a forearm guard, said forearm guard comprising;

a first panel having a front edge, a rear edge, a first lateral edge and a second lateral edge, said first panel being comprised of a flexible material;

a coupler being attached to said first panel for selectively coupling an inner surface of said first panel adjacent to said first lateral edge to an outer surface of said first panel adjacent to said second lateral edge;

extending said forearm guard around a forearm such that said front edge extends around a wrist, coupling said armguard to the forearm with said coupler;

providing an upper armguard, said upper armguard comprising;

a second panel having an upper edge, a lower edge, a first side edge and a second side edge, said second panel being comprised of a flexible material;

a biasing member being attached to said second panel for biasing said first and second side edges toward each other;

extending an arm between said biasing member and said second panel such that said upper armguard is positioned on a front portion of an upper arm;

providing a chest protector, said chest protector comprising;

a third panel having a top edge, a bottom edge, a first outer edge and a second outer edge, said third panel being comprised of a flexible material;

a loop being integrally coupled to and extending upwardly from said top edge;

a tether having a first end attached to said first outer edge and a second end attached to said second outer edge; and, extending a torso between said tether and said third panel and a head through said loop such that said chest protector is positioned on a chest of the body.

2. The method according to claim 1, wherein said flexible material of said first and second panels comprises a polystyrene material.

3. The method according to claim 2, wherein each of said first and second panels have a thickness less than ½ inch.

4. The method according to claim 1, wherein a width of said first panel decreases from said rear edge to said front edge.

5. The method according to claim 4, wherein said rear edge has a length generally between 8 inches and 12 inches, said front edge having a length generally between 7 inches and 10 inches, said first panel having a width from said first lateral edge to said second lateral edge generally between 10 inches and 16 inches, a width of said second panel from said first side edge to said second side edge being generally between 10 inches and 14 inches, said second panel having a height from said lower edge to said upper edge generally between 5 inches and 8 inches.

6. The method according to claim 4, wherein said coupler comprises a hook and loop coupling means extending along said first and second lateral side edges.

7. The method according to claim 6, wherein said biasing member comprises at least one elastic band having a first end attached to said first side edge and a second end attached to said second side edge.

8. The method according to claim 5, further including the steps of:

providing a chest protector, said chest protector comprising;

a third panel having a top edge, a bottom edge, a first outer edge and a second outer edge, said third panel being comprised of a flexible material, a width of said third panel from said first outer edge to said second outer edge being generally between 12 inches and 20 inches, said third panel having a height from said bottom edge to said top edge generally between 14 inches and 18 inches;

a loop being integrally couplet to and extending upwardly from said top edge;

a tether having a first end attached to said first outer edge and a second end attached to said second outer edge; and extending a torso between said tether and said third panel and a head through said loop such that said chest protector is positioned on a chest of the body.

9. A method of protecting portions of a body from sunlight, comprising the steps of:

providing a forearm guard, said forearm guard comprising;

a first panel having a front edge, a rear edge, a first lateral edge and a second lateral edge, said first panel being comprised of a flexible polystyrene material, said first panel having a thickness less than ½ inch, a width of said first panel decreasing from said rear edge to said front edge, said rear edge having a length generally between 8 inches and 12 inches, said front edge having a length generally between 7 inches and 10 inches, said first panel having a width from said first lateral edge to said second lateral edge generally between 10 inches and 16 inches;

a coupler being attached to said first panel for selectively coupling an inner surface of said first panel adjacent to said first lateral edge to an outer surface of said first panel adjacent to said second lateral edge, said coupler comprising a hook and loop coupling means extending along said first and second lateral side edges;

extending said forearm guard around a forearm such that said front edge extends around a wrist, coupling said armguard to the forearm with said coupler;

providing an upper armguard, said upper armguard comprising;

a second panel having an upper edge, a lower edge, a first side edge and a second side edge, said second panel being comprised of a flexible polystyrene material, said second panel having a thickness less than ½ inch, a width of said second panel from said first side edge to said second side edge being generally between 10 inches and 14 inches, said second panel having a height from said lower edge to said upper edge generally between 5 inches and 8 inches;

a biasing member being attached to said second panel for biasing said first and second side edges toward each other, said biasing member comprising at least one elastic band having a first end attached to said first side edge and a second end attached to said second side edge;

extending an arm between said biasing member and said second panel such that said upper armguard is positioned on a front portion of an upper arm;

providing a chest protector, said chest protector comprising;

a third panel having a top edge, a bottom edge, a first outer edge and a second outer edge, said third panel being comprised of a flexible polystyrene material, said third panel having a thickness less than ½ inch, a width of said third panel from said first outer edge to said second outer edge being generally between 12 inches and 20 inches, said third panel having a height from said bottom edge to said top edge generally between 14 inches and 18 inches;

a loop being integrally coupled to and extending upwardly from said top edge, said loop being comprised of a flexible polystyrene material, said loop being angled back with respect to a front side of said third panel;

a tether having a first end attached to said second outer edge, said tether comprising a resiliently elastic material; and extending a torso between said tether and said third panel and a head through said loop such that said chest protector is positioned on a chest of the body.

10. A method of protecting portions of a body from sunlight, comprising the steps of:

providing a forearm guard, said forearm guard comprising;

a first panel having a front edge, a rear edge, a first lateral edge and a second lateral edge, said first panel being comprised of a flexible material;

a coupler being attached to said first panel for selectively coupling an inner surface of said first panel adjacent to said first lateral edge to an outer surface of said first panel adjacent to said second lateral edge;

extending said forearm guard around a forearm such that said front edge extends around a wrist, coupling said armguard to the forearm with said coupler;

providing an upper armguard, said upper armguard comprising;

a second panel having an upper edge, a lower edge, a first side edge and a second side edge, said second panel being comprised of a flexible material;

a biasing member being attached to said second panel for biasing said first and second side edges toward each other;

extending an arm between said biasing member and said second panel such that said upper armguard is positioned on a front portion of an upper arm;

wherein a width of said first panel decreases from said rear edge to said front edge.

wherein said rear edge has a length generally between 8 inches and 12 inches, said front edge having a length generally between 7 inches and 10 inches, said first panel having a width from said first lateral edge to said second lateral edge generally between 10 inches and 16 inches, a width of said second panel from said first side edge to said second side edge being generally between 10 inches and 14 inches, said second panel having a height from said lower edge to said upper edge generally between 5 inches and 8 inches; and, providing a chest protector, said chest protector comprising;

a third panel having a top edge, a bottom edge, a first outer edge and a second outer edge, said third panel being comprised of a flexible material, a width of said third panel from said first outer edge to said second outer edge being generally between 12 inches and 20 inches, said third panel having a height from said bottom edge to said top edge generally between 14 inches and 18 inches;

a loop being integrally couplet to and extending upwardly from said top edge;

a tether having a first end attached to said first outer edge and a second end attached to said second outer edge; and extending a torso between said tether and said third panel and a head through said loop such that said chest protector is positioned on a chest of the body.

* * * * *